US009806413B1

(12) United States Patent
Chukka et al.

(10) Patent No.: US 9,806,413 B1
(45) Date of Patent: Oct. 31, 2017

(54) AUTOMATIC CONTROL OF SPACING BETWEEN ANTENNA DIPOLE COLUMNS

(71) Applicant: Sprint Communications Company L.P., Overland Park, KS (US)

(72) Inventors: Chaitanya Chukka, Overland Park, KS (US); Sreekar Marupaduga, Overland Park, KS (US); Andrew M. Wurtenberger, Olathe, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 547 days.

(21) Appl. No.: 14/104,899

(22) Filed: Dec. 12, 2013

(51) Int. Cl.
*H01Q 3/02* (2006.01)

(52) U.S. Cl.
CPC ..... *H01Q 3/02* (2013.01)

(58) Field of Classification Search
CPC ..... H01Q 3/02
USPC ..... 343/758
See application file for complete search history.

(56) References Cited

U.S. PATENT DOCUMENTS

| | | | | |
|---|---|---|---|---|
| 4,933,682 | A * | 6/1990 | Vaughan | H01Q 21/29 342/424 |
| 5,751,247 | A * | 5/1998 | Nomoto | H04B 7/18517 342/359 |
| 6,016,123 | A * | 1/2000 | Barton | H01Q 1/246 342/373 |
| 7,427,962 | B2 * | 9/2008 | Yang | H01Q 3/04 343/757 |
| 2006/0017626 | A1 * | 1/2006 | Kannan | H01Q 1/088 343/702 |

* cited by examiner

*Primary Examiner* — Dameon E Levi
*Assistant Examiner* — Walter Davis

(57) ABSTRACT

Methods and systems are provided for modifying spacing in between a plurality of antenna dipole columns on an antenna associated with a wireless communications network. A first signaling technology currently employed by a base station is determined, where the first signaling technology requires each of the antenna dipole columns to be separated from one another by a first distance. It is then determined that a second signaling technology is to be employed by the base station, the second signaling technology requiring each of the antenna dipole columns to be separated from one another by a second distance. A signaling message is communicated to a movement mechanism, causing at least one of the antenna dipole columns to move so that the columns are spaced at the second distance from one another.

20 Claims, 5 Drawing Sheets

AUTOMATIC CONTROL OF SPACING BETWEEN ANTENNA DIPOLE COLUMNS

SUMMARY

A high level overview of various aspects of the invention is provided here for that reason, to provide an overview of the disclosure and to introduce a selection of concepts that are further described below in the detailed-description section below. This summary is not intended to identify key features or essential features of the claimed subject matter, nor is it intended to be used as an aid in isolation to determine the scope of the claimed subject matter.

In brief, and at a high level, this disclosure describes, among other things, systems and methods that allow antenna dipole columns on an antenna at a base station to move in order to adjust spacing between each of the antenna dipole columns. Various signaling technologies may be utilized, but typically only one is supported at any one base station. However, utilizing embodiments of the technology described herein, because the columns may be moved to a different position, spacing between the columns can be adjusted, thus enabling more than one signaling technology to be utilized at a single base station. The antenna dipole columns may be moved by way of a motor that drives a gear, for example. Further, the antenna dipole columns may be movably secured to a railing mechanism. There are many ways that the columns may be moved relative to one another, thus enabling the distance between the columns to be adjusted. Further, in one embodiment, the distance between each of the antenna dipole columns is equivalent given a particular signaling technology that is being employed at the base station. Allowing the spacing between antenna dipole columns to be selectively modified enables the base station to more effectively serve the mobile devices, which improves the network subscriber's experience.

BRIEF DESCRIPTION OF THE DRAWINGS

Illustrative embodiments of the present invention are described in detail below with reference to the attached drawing figures, and wherein.

DETAILED DESCRIPTION

Figure 1:
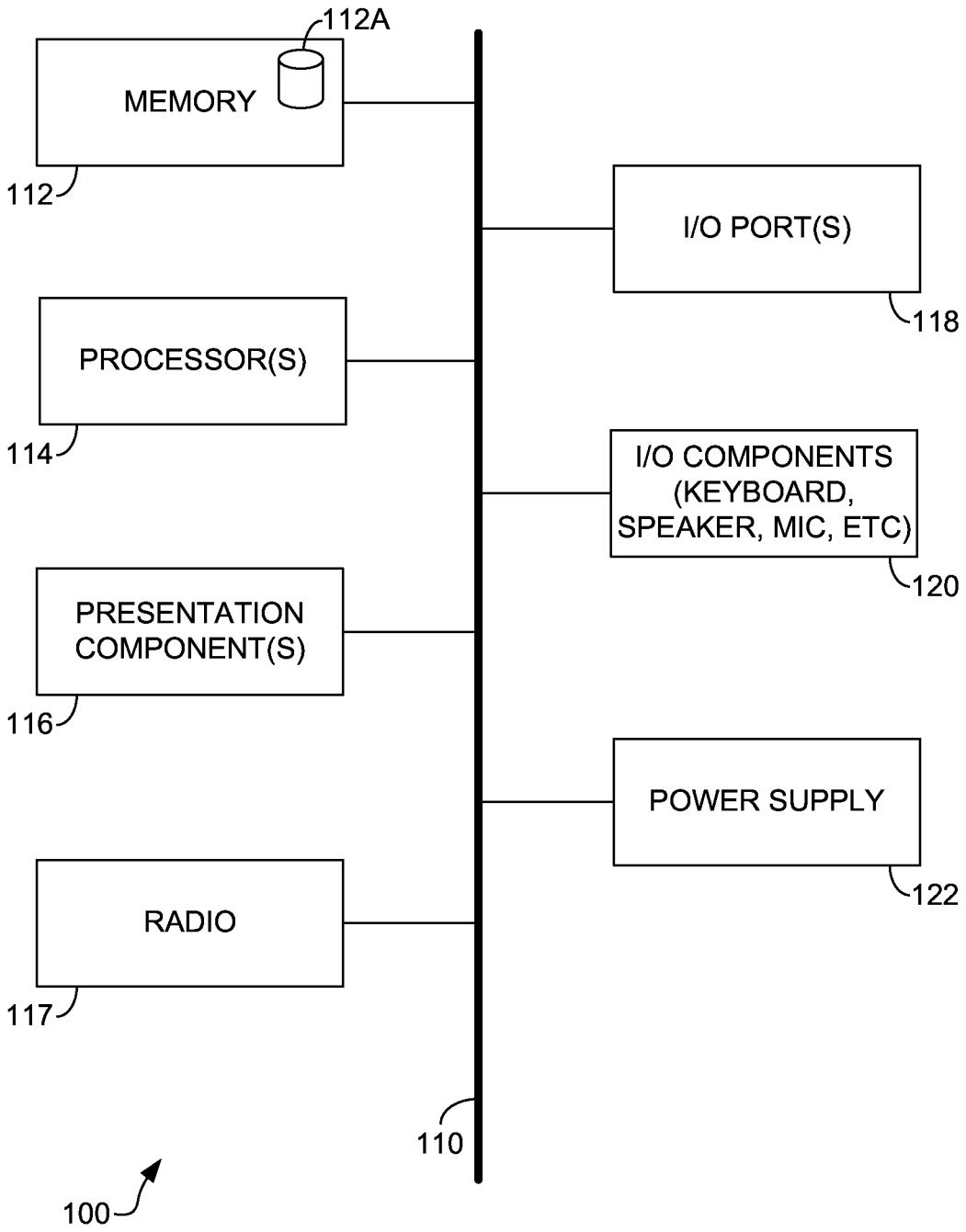
FIG. 1 depicts an exemplary mobile device according to an embodiment of the technology.

The subject matter of select embodiments of the present invention is described with specificity herein to meet statutory requirements. But the description itself is not intended to define what we regard as our invention, which is what the claims do. The claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Throughout this disclosure, several acronyms and shorthand notations are used to aid the understanding of certain concepts pertaining to the associated system and services. These acronyms and shorthand notations are intended to help provide an easy methodology of communicating the ideas expressed herein and are not meant to limit the scope of the present invention. The following is a list of these acronyms:

BBU Baseband Unit
BF Beam forming
BS Base Station
CDMA Code Division Multiple Access
eNodeB Evolved Node B
GPRS General Packet Radio Service
GSM Global System for Mobile Communications
LTE Long-Term Evolution
MIMO Multiple-Input-Multiple-Output
RF Radio-Frequency
RRU Remote Radio Unit
WCDMA Wideband Code Division Multiple Access Further, various technical terms are used throughout this description. An illustrative resource that fleshes out various aspects of these terms can be found in Newton's Telecom Dictionary, 27th Edition (2012).

Embodiments of our technology may be embodied as, among other things, a method, system, or computer-program product. Accordingly, the embodiments may take the form of a hardware embodiment, or an embodiment combining software and hardware. In one embodiment, the present invention takes the form of a computer-program product that includes computer-useable instructions embodied on one or more computer-readable media.

Computer-readable media include both volatile and nonvolatile media, removable and nonremovable media, and contemplate media readable by a database, a switch, and various other network devices. Network switches, routers, and related components are conventional in nature, as are means of communicating with the same. By way of example, and not limitation, computer-readable media comprise computer-storage media and communications media.

Computer-storage media, or machine-readable media, include media implemented in any method or technology for storing information. Examples of stored information include computer-useable instructions, data structures, program modules, and other data representations. Computer-storage media include, but are not limited to RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These memory components can store data momentarily, temporarily, or permanently.

Communications media typically store computer-useable instructions—including data structures and program modules—in a modulated data signal. The term "modulated data signal" refers to a propagated signal that has one or more of its characteristics set or changed to encode information in the signal. Communications media include any informationdelivery media. By way of example but not limitation, communications media include wired media, such as a wired network or direct-wired connection, and wireless media such as acoustic, infrared, radio, microwave, spread-spectrum, and other wireless media technologies. Combinations of the above are included within the scope of computer-readable media.

Embodiments of the present invention are directed towards adjustment of spacing between antenna dipole columns to allow for a base station to support multiple signaling technologies such as, for example, MIMO and beam forming. While typical cell towers allow for only one signaling technology to be utilized at that tower or base station because of stationary or non-moveable antenna dipole columns, embodiments of the present invention allow for these columns to be moved, thus adjusting the spacing between each of the antenna dipole columns. For instance, for a 65 degree beam width antenna, separation of less than 0.65λ, where λ (Lambda) is the wavelength corresponding to the transmission frequency, may be preferred for beam forming capabilities, but a higher separation (λ of 1 or greater) is typically preferred for MIMO so that the signals can be coherent and decorrelated. For both of these signaling technologies to be supported, the columns may be movable such as, for example, by way of a railing system movably secured to the columns. The use of a railing slide or small wheels allows for movement of the columns. A motor, drives, gears, or a combination thereof may be utilized to cause the movement. The base station, such as an eNodeB, in one embodiment, determines which signaling technology is to be used at a particular time. When a switch to a different signaling technology is to be made, the base station may send a signaling message to a processor coupled to the motor, which then causes at least a portion of the antenna dipole columns to move to a new position.

Accordingly, in a first aspect, a system is provided for modifying spacing between a plurality of dipole columns that comprise an antenna associated with a wireless communications network. The system includes two or more antenna dipole columns whose distance between one another can be modified such that the distance between each of the two or more antenna dipole columns is, at least, a first distance or a second distance, wherein the first distance is shorter than the second distance. The system further includes a movement mechanism that allows for at least one of the two or more antenna dipole columns to move along a longitudinal axis, the movement along the longitudinal axis causing the distance between the each of the two or more antenna dipole columns to increase or decrease to the first distance or the second distance. Additionally, the system includes a signal receiving component that receives a signal from a base station in the wireless communications network instructing the distance between the each of the two or more antenna dipole columns to be modified to the first distance or the second distance.

In a second aspect, a method carried out by at least one server having at least one processor for implementing modification of a spacing between dipole columns on an antenna associated with a wireless communications network is provided. The method includes determining that a base station is currently employing a first signaling technology. Two or more antenna dipole columns of the antenna are spaced at a first distance from one another when the first signaling technology is employed. The method further includes determining that the base station is to begin employing a second signaling technology, the second signaling technology requiring each of the two or more antenna dipole columns of the antenna to be spaced at a second distance from one another, the first distance being different from the second distance. Even further, the method includes communicating a signaling message to a movement mechanism that causes at least one of the two or more antenna dipole columns to move such that the two or more antenna dipole columns are spaced at the second distance from one another.

In a third aspect, one or more computer-storage media having computer-executable instructions embodied thereon that, when executed, perform a method for modifying spacing between dipole columns on an antenna associated with a wireless communications are provided. The method includes receiving a signaling message indicating that a distance between each of two or more antenna dipole columns on an antenna is to be modified from a first distance to a second distance based on a transition from a first signaling technology to a second signaling technology at a base station associated with the antenna. The two or more antenna dipole columns of the antenna are spaced at the first distance from one another when the first signaling technology is employed, and the two or more antenna dipole columns of the antenna are spaced at the second distance from one another when the second signaling technology is employed, the first distance being different from the second distance. Further, the method includes causing at least one of the two or more antenna dipole columns on the antenna to move according to the signaling message.

Referring to the drawings in general, and initially to FIG. 1 in particular, a block diagram of an illustrative computing device according to one embodiment is provided and referenced generally by the numeral 100. Although some components are shown in the singular, they may be plural. For example, computing device 100 might include multiple processors or multiple radios, etc. As illustratively shown, computing device 100 includes a bus 110 that directly or indirectly couples various components together including memory 112, a processor 114, a presentation component 116, a radio 117 (if applicable), input/output ports 118, input/output components 120, and a power supply 122.

Memory 112 might take the form of memory components previously described. Thus, further elaboration will not be provided here, only to say that memory component 112 can include any type of medium that is capable of storing information (e.g., a database). A database can be any collection of records. In one embodiment, memory 112 includes a set of embodied computer-executable instructions 112A that, when executed, facilitate various aspects disclosed herein. These embodied instructions will variously be referred to as "instructions" or an "application" for short.

Processor 114 might actually be multiple processors that receive instructions and process them accordingly. Presentation component 116 includes the likes of a display, a speaker, as well as other components that can present information (such as a lamp (LED), or even lighted keyboards).

Numeral 117 represents a radio(s) that facilitates communication with a wireless-telecommunications network. Illustrative wireless telecommunications technologies include CDMA, GPRS, TDMA, GSM, WiMax, LTE, and the like. In some embodiments, radio 117 might also facilitate other types of wireless communications including Wi-Fi communications and GIS communications. As can be appreciated, in various embodiments, radio 117 can be configured to support multiple technologies and/or multiple radios can be utilized to support a technology or multiple technologies.

Input/output port 118 might take on a variety of forms. Illustrative input/output ports include a USB jack, stereo jack, infrared port, proprietary communications ports, and the like. Input/output components 120 include items such as keyboards, microphones, speakers, touch screens, and any other item usable to directly or indirectly input data into communications device 100. Power supply 122 includes items such as batteries, fuel cells, or any other component that can act as a power source to power communications device 100.

By way of background, a base station, such as an eNodeB in an LTE telecommunications network is composed of, among other components, a broadband unit (BBU) that is connected to one or more remote radio units (RRUs). In turn, each RRU is typically connected directly to one or more antenna ports associated with an antenna located on the base station. In general, the BBU is responsible for, among other things, digital baseband signal processing. For instance, CDMA/EVDO and LTE Internet protocol (IP) packets are received from the core network (not shown) and are digitally combined by the BBU. The blended digital baseband signal is then transmitted to the RRU. Digital baseband signals received from the RRU are demodulated by the BBU and the resulting IP packets are then transmitted by the BBU to the core network.

The RRU transmits and receives wireless RF signals. The RRU converts the blended digital signal received from the BBU into an analog RF output via a digital to analog (AD) converter. The analog signal is then amplified by an amplifier in the RRU and sent out for transmission to a mobile device via the antenna ports. The RF signals received from the mobile device via the antenna ports are amplified by the RRU and converted to digital baseband signals for transmission to the BBU.

Beam forming is a technology that is prominently used in LTE wireless transmission, and can enhance cell coverage. MIMO is another space diversity technology also used in LTE wireless transmission to increase the data throughputs. The main concern of current antenna technology is insufficiency to provide them both with similar hardware. Both of these technologies are supported by LTE standards and are very much required for a competitive network to meet current data usage requirements. The dipole elements inside the antenna have horizontal spacing, known as lambda spacing, between the different columns, also termed ports. The spacing between columns is the main determination as to which of beam forming, MIMO or some other signaling technology is implemented at a base station. For instance, for a 65 degree beam width antenna, separation of less than $0.65\lambda$, where $\lambda$ (Lambda) is the wavelength corresponding to the transmission frequency, may be preferred for beam forming capabilities, but a higher separation ($\lambda$ of 1 or greater) is typically preferred for MIMO so that the signals can be coherent and decorrelated.

Embodiments of the present invention allow for separation involving the antenna dipole columns using a motor, such as a digital stepper motor, based on a signal, such as an AISG signal, sent from the RRU. The motor, in one embodiment, is located at the base of the antenna or cell tower, and can work to move the antenna dipole columns horizontally closer or farther from one another based on load requirements and other factors. The RRU is able to acquire information regarding traffic on the sector, and also Quality Class Indicators, bandwidth requirements of mobile devices within the coverage area, etc. Using this input information, an RRU is able to send signals to the motor and later the propagation characteristics of the antenna radiation to ultimately benefit the users. The antenna dipole columns may be on a mechanically installed mechanism for positioning and movement using a railing slide or small wheels. An electro mechanical pulley system may also or alternatively be involved to modify the position of the columns when the output of the motor changes with respect to the RRU remote command. This may cause the antennas to be more active so as to accommodate the current data usage trends and possibly move toward the complete controllable and active antenna in the future. This technology allows for advantages of both beam forming and MIMO capabilities, upgraded throughput speeds, enhanced coverage, automatic remote control with/without user intervention, utilization of an existing AISG protocol, and reduction in dropped and blocked calls, in addition to many other advantages not specifically listed herein.

Figure 2:
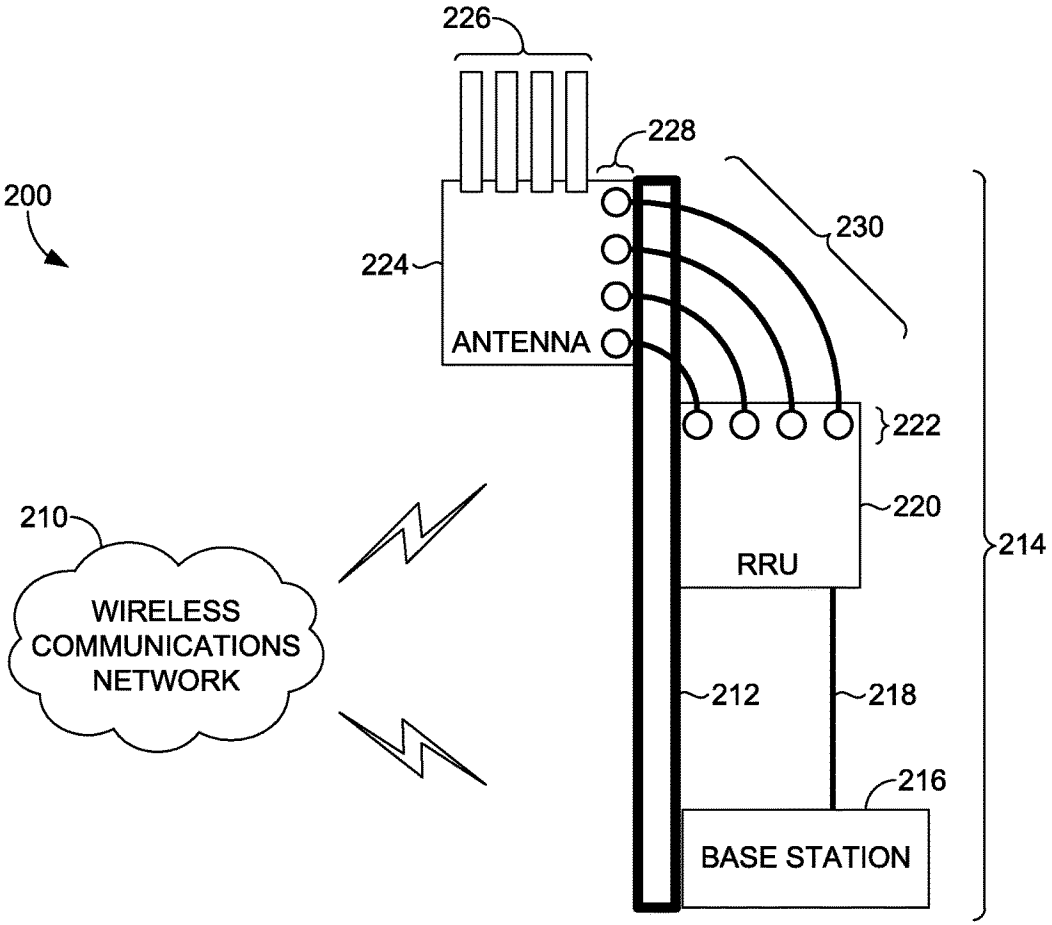
FIG. 2 depicts a diagram of a wireless communications network in communication with an exemplary cell tower.

Turning now to FIG. 2, an exemplary environment suitable for use in implementing embodiments of the present invention is illustrated and designated generally as environment 200. Environment 200 is but one example of a suitable environment and is not intended to suggest any limitation as to the scope of use or functionality of the invention. Neither should the environment be interpreted as having any dependency or requirement relating to any one or combination of components illustrated.

In the environment 200, a radio tower 212 is installed in environment 200. A radio tower is typically a tall structure designed to support an antenna(s) for telecommunications and/or broadcasting. A radio tower is not intended herein to be limited to any shape and/or structure. For example, a radio tower 212 may be a building or pole on which a transmitting antenna is installed. In other embodiments, a mobile radio tower may be employed.

As illustrated in FIG. 2, the radio tower 212 includes or is associated with a base station 216, a remote radio unit (RRU) 220, and an antenna 224. Collectively, these components are referred to as a cell tower 214. In embodiments, base station 216 is a wireless communications station that is installed at a fixed location, such as near the base of the radio tower 212. In other embodiments, base station 216 is a mobile base station. The base station 216 is used to communicate as part of a wireless communications network 210. For example, base station 216 facilitates wireless communication between user devices and a network(s). A user device include a device that uses a wireless communications network. A user device may take on a variety of forms, such as a personal computer (PC), a laptop computer, a tablet, a mobile phone, a personal digital assistant (PDA), a server, or any other device that is capable of communicating with other devices using a wireless telecommunications network. In one embodiment, a user device is the user device described in relation to FIG. 1 herein. Such a network might be a single network or multiple networks, as well as being a network of networks. A network(s) might comprise, for example, a cable network, an Intranet, the Internet, a wireless network (e.g., a wireless telecommunications network), or a combination thereof or portions thereof.

The base station 216 can communicate with the RRU 220. In embodiments, RRU 220 is a transceiver or includes a transceiver configured to receive and transmit signals or data. In some embodiments, the RRU 220 is integrated with the base station 216. In other embodiments, as illustrated in FIG. 2, the RRU 220 is remote from the base station 216. In such an embodiment, the base station 216 can communicate with the RRU 220, for example, using a data transmission path 218, such as a fiber optic cable.

Although the RRU 220 is illustrated at or near the top of the radio tower 212, as can be appreciated, the RRU 220 can be installed in any number of locations and such an installation location is not intended to limit the scope of embodiments of the present invention. For example, the RRU 220 can be installed at or near the bottom of the radio tower 212, in the center of the radio tower 212, integrated with the base station 216, or the like.

The RRU 220 generally communicates with the antenna 224. In this regard, the RRU 220 is used to transmit signals or data to the antenna 224 and receive signals or data from the antenna 224. Communications between the RRU 220 and the antenna 224 can occur using any number of physical paths. A physical path, as used herein, refers to a path used for transmitting signals or data. As such, a physical path may be referred to as a radio frequency (RF) path, a coaxial cable path, cable path, or the like.

As such, RRU 220 includes one or more ports 228 used to connect one or more physical paths 230 to one or more ports 222 on the RRU 220. For instance, a first port can connect a first physical path to a radio, a second port can connect a second physical path to the radio, a third port can connect a third physical path to the radio, and a fourth port can connect a fourth physical path to the radio.

The antenna 224 is used for telecommunications. Generally, an antenna is an electrical device that converts electric power into radio waves and converts radio waves into electric power. The antenna 224 is typically positioned at or near the top of the radio tower 212. Such an installation location, however, is not intended to limit the scope of embodiments of the present invention.

The antenna 224 includes two or more antenna dipole columns 226. While four antenna dipole columns 226 are illustrated in FIG. 2, any number of antenna dipole columns 226 is contemplated to be within the scope of the present invention. For instance, instead of four, eight antenna dipole columns 226 could be utilized. Each column may include two dipole elements. The antenna dipole columns are described in further detail in FIG. 3 herein. Generally, each of the antenna dipole columns are spaced in a manner that allows for beam forming, MIMO, or some other signal forming technology to be utilized at that particular base station. One reason that typical base stations utilize just one beam-forming technology is the required or optimal spacing between the antenna dipole columns 226. For instance, beam forming typically requires spacing of 0.5-0.65λ, while MIMO technology typically requires spacing of at least 1λ. This is partially due to beam-forming focusing energy within a smaller geographical area, providing higher signal-to-noise ratio to an end user, higher throughput, and farther reach. On the other hand, MIMO technology utilizes independent paths. Orthogonality helps with decorrelation between paths when MIMO is utilized.

Utilizing embodiments of the present invention, a single base station is capable of utilizing at least beam-forming and MIMO technologies. This is accomplished by providing movement capabilities to the antenna dipole columns 226. For instance, a movement mechanism may be provided that allows for the at least a portion of the antenna dipole columns to move along a longitudinal axis, causing the distance between each of the antenna dipole columns 226 to increase or decrease, depending on which signaling technology is to be utilized at that time. For instance, in an exemplary embodiment, if the current signaling technology being used at a particular base station is beam forming, but based on an assessment of various factors, it would be more efficient or effective to switch to MIMO, a base station component, such as an eNodeB in the case of LTE technology, may make this determination and send a signaling message to a processor, such as a signal-receiving component that receives a signal from the base station in the wireless communications network instructing the distance between each of the antenna dipole columns to be modified to the first distance or the second distance. This signaling message may cause a motor to run, which in turn causes at least a portion of the antenna dipole columns 226 to move to a different position so that the spacing between each of the antenna dipole columns is increased. In one embodiment, the spacing between each of the antenna dipole columns 226 is equivalent, whether the distance between each is a shorter distance, such as for beam-forming technology, or whether the distance is a greater distance, such as for MIMO technology. A more detailed description of exemplary systems used for moving the antenna dipole columns 226 can be found herein with reference to FIG. 4.

Figure 3:
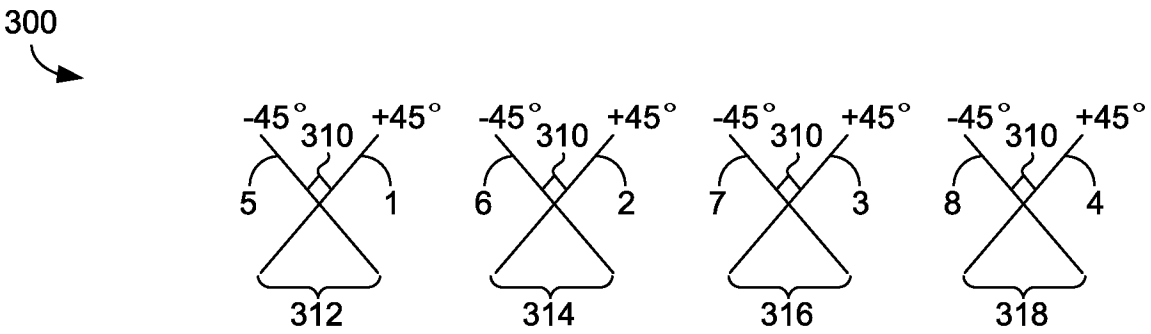
FIG. 3 depicts an exemplary illustration of multiple antenna dipole columns suitable for practicing an embodiment of the technology.

FIG. 3 illustrates details associated with a typical 8-port antenna 300 used in an LTE network that supports TM8 MIMO and beam-forming modes. The antenna 300 comprises eight antenna elements configured into two groups. A first antenna group comprises antenna elements 1, 2, 3, and 4, and a second antenna group comprises antenna elements 5, 6, 7, and 8. Antenna elements 1, 2, 3, and 4 are polarized at plus 45 degrees (+45°), and antenna elements 5, 6, 7, and 8 are polarized at minus 45 degrees (−45°). Additionally, the first group of antenna elements (antenna elements 1, 2, 3, and 4) are orthogonally cross-polarized at 90 degrees to the second group of antenna elements (antenna elements 5, 6, 7, and 8) as indicated by the numeral 310. As shown in FIG. 3, antenna element 1 is orthogonally cross-polarized to antenna element 5 and together the antenna elements comprise a first antenna dipole column 312. Likewise, antenna element 2 is orthogonally cross-polarized with antenna element 6 and together they comprise a second antenna dipole column 314, antenna element 3 is orthogonally cross-polarized with antenna element 7 and together they comprise a third antenna dipole column 316, and antenna element 4 is orthogonally cross-polarized with antenna element 8 and together they comprise a fourth antenna dipole column 318.

Additionally, the antenna dipole columns 312, 314, 316, and 318 are each separated by a distance that is beneficial for the signaling technology currently being used by a base station. For instance, as mentioned above, beam forming typically requires spacing of 0.5-0.65λ, while MIMO technology typically requires spacing of at least 1λ. This is partially due to beam-forming focusing energy within a smaller geographical area, providing higher signal-to-noise ratio to an end user, higher throughput, and farther reach. On the other hand, MIMO technology utilizes independent paths.

Figure 4:
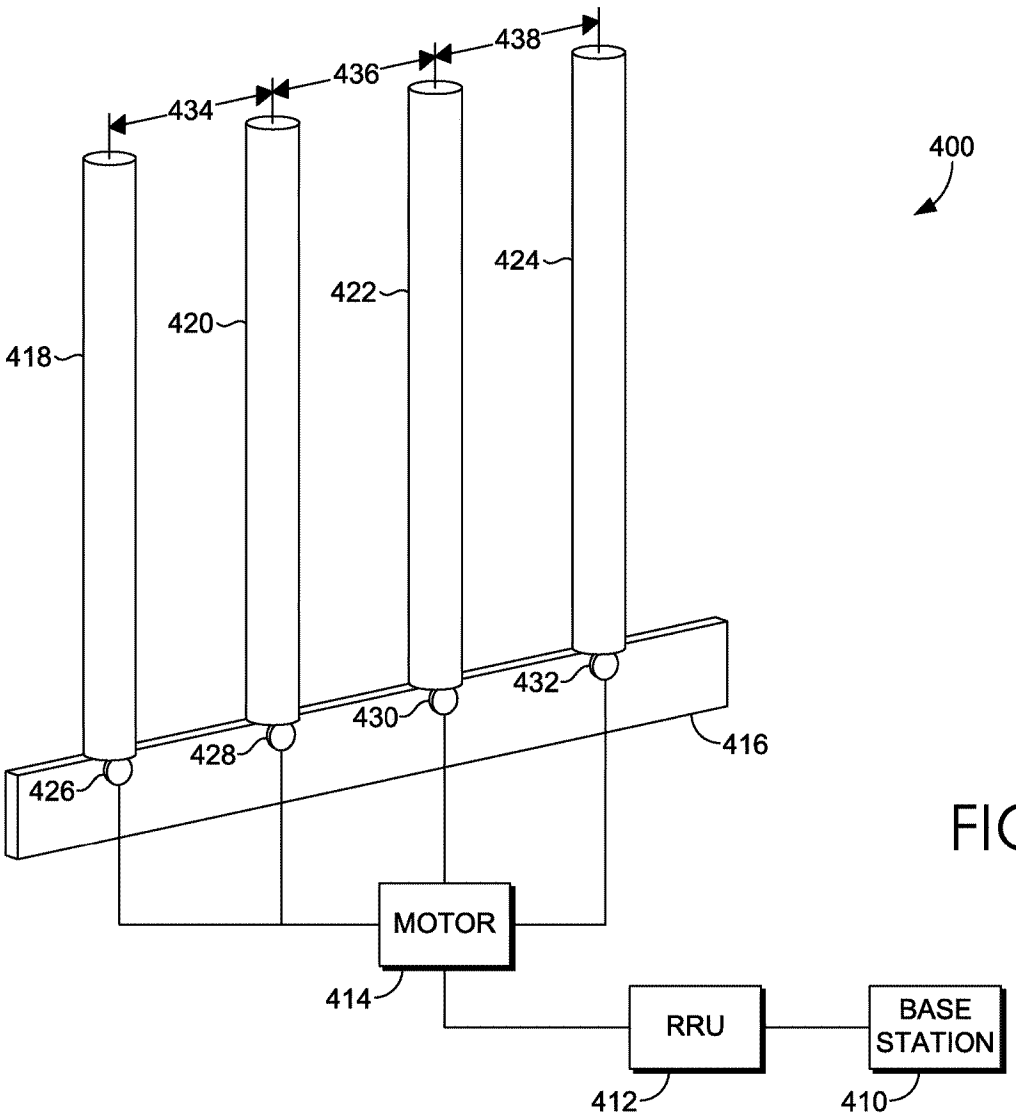
FIG. 4 depicts an exemplary system diagram illustrating a system for modifying spacing between antenna dipole columns of an antenna in a wireless communications network.

Turning now to FIG. 4, a diagram, referred to generally by numeral 400, is shown illustrating the ability to modify spacing between antenna dipole columns 418, 420, 422, and 424 based on a current signaling technology, according to an embodiment of the present invention. FIG. 4 illustrates a base station 410, an RRU 412, and a motor 414. As mentioned, the base station 410 is typically responsible for handling traffic and signaling between a mobile device and the network switching subsystem. A base station 410 may include, for instance, a base transceiver station (BTS) that contains the equipment for transmitting and receiving radio signals, antennas, and equipment for encrypting and decrypting communications with the base station controller (BSC). The BSC is the intelligence behind the BTS, handling allocation of radio channels, receives measurements from the mobile devices, and controls handovers from one BTS to another. In one embodiment, the BTS is an eNodeB, such as when LTE technology is utilized. In embodiments, the base station makes the determination as to whether beam forming, MIMO, or some other signaling technology is to be used.

Various factors may be taken into consideration by the base station or other network component that makes this determination. For instance, the current mobility of the mobile devices in the sector, whether in-building penetration is needed, current bandwidth requirements of the mobile devices in the sector, whether the majority of users are closer to the tower or farther away, QCI of the mobile devices, traffic, etc. In one embodiment, the determination is made considering all or a majority of the mobile devices/users in the sector, but in another embodiment, the determination is made on a per-user basis. For instance, if a user is at the edge of the coverage area but requires more bandwidth, a determination may be made to switch to beam forming such that the cell edge user can be reached at higher throughputs. Alternatively, MIMO may be used to improve capacity and throughput when the majority of users are relatively near the base station and not at the cell's edge. Additionally, in one embodiment, there are preset blocks of time in a day or other time frame when beam forming is to be used, and other preset blocks of time when MIMO is to be used. For instance, during the night, it may be determined that beam forming is to be used, as mobile devices are not highly mobile during this time. During morning and afternoon/evening commutes, however, MIMO may be selected to account for the highly mobile nature of mobile devices during these times. In another embodiment, however, the determination as to which signaling technology is utilized is made on an as-needed basis, such as in real time.

Returning to FIG. 4, the base station 410, in one embodiment, makes the determination as to which signaling technology is to be utilized at the current time. As mentioned, this process could take place in real-time or could be pre-determined, such as in preset blocks of time. A signaling message is sent to the motor 414, indicating that the antenna dipole columns are to be moved, and by how much and in which direction they are to be moved. The antenna dipole columns are illustrated as having spacing or distance from one another by distances 434, 436, and 438. As mentioned, these distances 434, 436, and 438 are adjusted utilizing embodiments of the present invention based on a signaling technology that is to be used at a base station. In one embodiment, all antenna dipole columns move when switching from MIMO to beam forming or vice versa, but in an alternative embodiment, all but one of the outer antenna dipole columns moves. There are also other methods not specifically mentioned herein for increasing or decreasing the space between the antenna dipole columns, but that are contemplated to be within the scope of the present invention.

In embodiments, a movement mechanism is utilized that allows the antenna dipole columns 418, 420, 422, and 424 to move based on the signaling message sent by the base station 410. For instance, in one embodiment, the movement mechanism includes a railing 416. The antenna dipole columns 418, 420, 422, and 424 may be positioned on a railing 416, such as a single straight line railing such that the antenna dipole columns 418, 420, 422, and 424 move along the railing along a longitudinal axis. The railing may utilize railing slides, small wheels, etc. One or more of the antenna dipole columns 418, 420, 422, and 424 may have an associated drive (e.g., gear, motor, or screw drive), illustrated as drives 426, 428, 430, and 432. Additionally, the movement mechanism may include an electro-mechanical pulley system to change the position of the columns when the signaling message is received. Even further, the motor 414 may cause gears to turn, thus adjusting the position of the antenna dipole columns 418, 420, 422, and 424. As can be appreciated, there are many different ways to cause the antenna dipole columns 418, 420, 422, and 424 to move from a first position to a second position, correlated to the columns being a first distance from one another to a second distance from one another. Other methods are contemplated to be within the scope of the present invention. For instance, the motor may have threads that are threaded one direction for one of the antenna dipole columns 418, 420, 422, and 424, and threaded in the other direction for another column. When the motor spins, the motor causes both columns to pull in or to push out. In embodiments, the motor is located at the bottom of the cell tower. But in other embodiments, more than one motor may be used, both either being at the bottom, at the top, or a combination thereof.

The ability to switch between different signaling modes by adjusting the spacing between the antenna dipole columns facilitates the ability of the base station to more effectively target mobile devices being served by the base station, which, in turn, improves the network subscriber's experience. Additionally, because the base station is able to target a greater number of mobile devices, this improved experience is broadened over a greater number of network subscribers.

Figure 5:
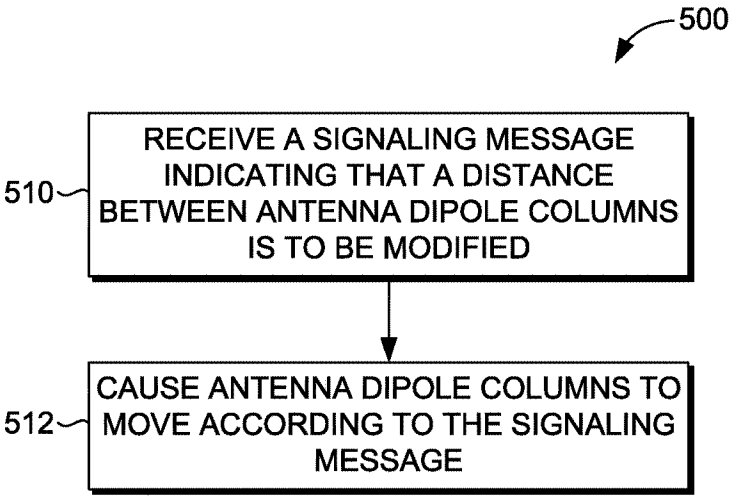
FIG. 5 depicts a flow diagram of an exemplary method for modifying a spacing between dipole columns on an antenna associated with a wireless communications network, according to an embodiment of the technology.

FIG. 5 depicts a flow diagram of an exemplary method 500 for modifying spacing between dipole columns on an antenna associated with a wireless communications network, according to an embodiment of the technology. Initially at step 510, a signaling message is received indicating that a distance between antenna dipole columns is to be modified. The distance, in one embodiment, is modified from a first distance to a second distance based on an intended transition from a first signaling technology to a second signaling technology at a base station associated with the antenna dipole columns. The antenna dipole columns of the antenna may be spaced at a first distance from one another when the first signaling technology is employed, and at a second distance form one another when the second signaling technology is employed. In some instance, the first distance and the second distance are different. Whether the antenna dipole columns are spaced at a first or a second distance from one another, there may be equal distance between each of the antenna dipole columns. In one embodiment, the first distance is associated with beam-forming technology, while the second distance is associated with MIMO technology.

At step 512, at least a portion of the antenna dipole columns are caused to move according to the signaling message, which, in one embodiment, is received from a microprocessor at a base station, such as an eNodeB. In one embodiment, the antenna dipole columns are movably coupled to a railing, allowing at least one of the antenna dipole columns to move from a first position to a second position, these positions corresponding to the distance between the antenna dipole columns. While two positions are mentioned herein, there may be more than two positions or two distances to which the antenna dipole columns are capable of moving. The number two is used for exemplary purposes only, and is not intended to limit embodiments of the technology.

Figure 6:
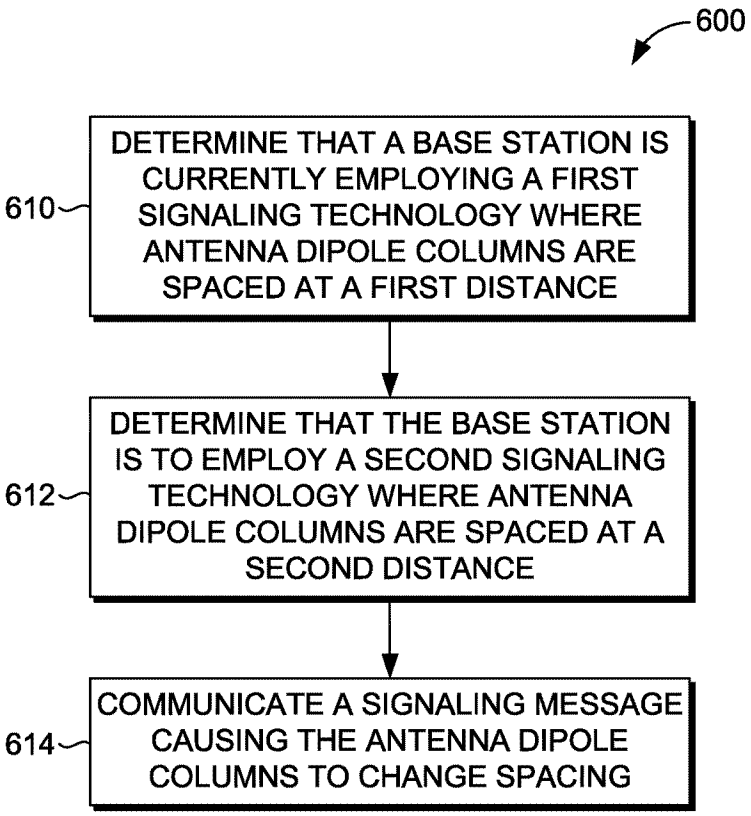
FIG. 6 depicts a flow diagram of an exemplary method for modifying a spacing between dipole columns on an antenna associated with a wireless communications network according to an embodiment of the technology.

Referring now to FIG. 6, a flow diagram is shown of an exemplary method 600 for modifying spacing between dipole columns on an antenna associated with a wireless communications network, according to an embodiment of the technology. At step 610, it is determined that a base station is currently employing a first signaling technology where antenna dipole columns are spaced at a first distance from one another. At step 612, it is determined that the base station is going to employ a second signaling technology requiring each of the antenna dipole columns of the antenna to be spaced at a second distance from one another. In embodiments, the first and second distances are different, and in other embodiments, the first distance is less than the second distance. In one embodiment, the base station determines that a second signaling technology is to be employed. This determination may be based on, for example, a mobility of mobile devices in a coverage area or sector of the base station, QCI values, traffic in the coverage area, bandwidth requirements of the mobile devices, or locations of one or more of the mobile devices in the coverage area. A signaling message is communicated at step 614 causing the antenna dipole columns to change spacing. In particular, the signaling message may be communicated to a movement mechanism that causes at least a portion of the antenna dipole columns to move such that they are spaced at a second distance from one another. Again, the first distance and the first signaling technology may correspond to beam-forming technology, while the second distance and the second signaling technology may correspond to MIMO technology.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A system for modifying spacing between a plurality of dipole columns that comprise an antenna associated with a wireless communications network, the system comprising:

two or more antenna dipole columns spaced a first distance apart, wherein the first distance is associated with the two or more antenna dipole columns sending and receiving cellular communication signals having a first signal transmission characteristic;

a signal-receiving component that receives a signal from a base station in the wireless communications network instructing the distance between the two or more antenna dipole columns be modified from the first distance to a second distance, wherein the second distance is associated with the antenna dipole columns sending and receiving cellular communication signals having a second signal transmission characteristic; and an automatic movement mechanism that subsequent to the signal-receiving component receiving the signal from the base station causes at least one of the two or more antenna dipole columns to automatically move along a longitudinal axis to a position where the two or more antenna dipole columns are spaced the second distance apart.

2. The system of claim 1, wherein the two or more antenna dipole columns comprise at least three antennal dipole columns and wherein the distance between each of the at least three antenna dipole columns is equivalent.

3. The system of claim 1, further comprising a motor coupled to the automatic movement mechanism, the motor causing the movement of the two or more antenna dipole columns along the longitudinal axis.

4. The system of claim 1, wherein the automatic movement mechanism comprises one or more screw drives.

5. The system of claim 1, wherein the automatic movement mechanism comprises one or more belt drives.

6. The system of claim 3, wherein the motor is a stepper motor.

7. The system of claim 1, wherein each of the two or more antenna dipole columns are movably coupled to a railing, and wherein the two or more antenna dipole columns are configured to move from a first position to a second position.

8. The system of claim 7, wherein the first position is associated with the first distance and the second position is associated with the second distance.

9. The system of claim 1, further comprising a third distance between the two or more antenna dipole columns.

10. The system of claim 1, wherein the wireless communications network operates at least a first signaling technology and a second signal technology and wherein the first distance between the two or more antenna dipole columns is associated with the first signaling technology, and the second distance between the two or more antenna dipole columns is associated with the second signaling technology.

11. A method carried out by at least one server having at least one processor for automatically implementing modification of a spacing between dipole columns on an antenna associated with a wireless communications network, the method comprising:

determining that a base station is currently employing a first signaling technology for sending and receiving cellular communication signals, wherein two or more antenna dipole columns of the antenna are spaced at a first distance from one another when the first signaling technology is employed;

determining that the base station is to begin employing a second signaling technology for sending and receiving cellular communication signals, the second signaling technology requiring each of the two or more antenna dipole columns of the antenna to be spaced at a second distance from one another, the first distance being different from the second distance;

instructing an automatic movement mechanism to move at least one of the two or more antenna dipole columns; and automatically moving at least one of the two or more antenna dipole columns to a position where the two or more antenna dipole columns are spaced at the second distance from one another.

12. The method of claim 11, wherein the first distance is less than the second distance.

13. The method of claim 11, wherein the first signaling technology is beam-forming technology and wherein the second signaling technology is Multiple Input Multiple Output (MIMO) technology.

14. The method of claim 11, wherein the determining that the base station is to begin employing a second signaling technology is based on one or more of:

mobility of mobile devices in a coverage area of the base station, quality class indicators (QCI), traffic in the coverage area, bandwidth requirements of the mobile devices in the coverage area, of and location of one or more of the mobile devices in the coverage area.

15. One or more computer-storage media having computer-executable instructions embodied thereon that, when executed, perform a method for automatically modifying a spacing between dipole columns on an antenna associated with a wireless communications network, the method comprising:

receiving a signaling message indicating that a distance between each of two or more antenna dipole columns on an antenna is to be modified from a first distance to a second distance based on a transition from a first signaling technology to a second signaling technology for sending and receiving cellular communication signals at a base station associated with the antenna, wherein, (1) the two or more antenna dipole columns of the antenna are spaced at the first distance from one another when the first signaling technology is employed, and (2) the two or more antenna dipole columns of the antenna are spaced at the second distance from one another when the second signaling technology is employed, the first distance being different from the second distance; and causing at least one of the two or more antenna dipole columns on the antenna to automatically move according to the signaling message.

16. The media of claim 15, wherein the signaling message is received from a microprocessor at the base station in the wireless communication network.

17. The media of claim 15, wherein the two or more antenna dipole columns comprise at least three antenna dipole columns and wherein each of the at least three antenna dipole columns are spaced at an equal distance from one another.

18. The media of claim 15, wherein the first distance is less than the second distance.

19. The media of claim 15, wherein the first signaling technology is beam-forming technology and wherein the second signaling technology is Multiple Input Multiple Output (MIMO) technology.

20. The media of claim 15, wherein the two or more antenna dipole columns are movably coupled to a railing, allowing at least one of the two or more antenna dipole columns to move from a first position to a second position, the first position and the second position corresponding to the distance between the two or more antenna dipole columns.

* * * * *